United States Patent [19]

Bergstrom

[11] Patent Number: 4,845,974

[45] Date of Patent: Jul. 11, 1989

[54] VEHICLE CHASSIS STRAIGHTENING BENCH

[75] Inventor: Hans R. Bergstrom, Kungsor, Sweden

[73] Assignee: Car-O-Liner Company, Wixom, Mich.

[21] Appl. No.: 212,872

[22] Filed: Jun. 29, 1988

[30] Foreign Application Priority Data

Jun. 30, 1987 [SE] Sweden ..... 8702700

[51] Int. Cl.[4] ..... B21D 01/12

[52] U.S. Cl. ..... 72/457; 72/705; 187/8.41

[58] Field of Search ..... 72/457, 705; 187/8.41, 187/8.43, 8.54, 8.61, 8.65; 254/2 B, 45

[56] References Cited

U.S. PATENT DOCUMENTS

| | | | |
|---|---|---|---|
| 2,442,425 | 6/1948 | Merrill et al. | 72/705 |
| 2,576,544 | 11/1951 | Smith | 72/388 |
| 3,518,867 | 7/1970 | Rouis | 72/705 |
| 3,777,541 | 12/1973 | Whitney | 72/705 |
| 4,238,114 | 12/1980 | Migliorati | 254/94 |

*Primary Examiner*—Lowell A. Larson

*Attorney, Agent, or Firm*—Barnes, Kisselle, Raisch, Choate, Whittemore & Hulbert

[57] ABSTRACT

A vehicle chassis straightening bench which includes a beam-frame having chassis clamps for securing the vehicle during a chassis straightening operation. The bench also has side ramp sections detachably mounted along the two longitudinal sides of the frame.

10 Claims, 2 Drawing Sheets

VEHICLE CHASSIS STRAIGHTENING BENCH

FIELD OF INVENTION

This invention relates to a Vehicle chassis straightening or alignment bench, and more particularly to an alignment bench with a rectangular, horizontal beam-frame moveable to a given position above a base plane; such as a shop floor and with a width which is narrower than the distance between the wheels of the respective wheel pairs of the vehicle.

BACKGROUND OF THE INVENTION

Known straightening or alignment benches normally comprise an elongated raisable and lowerable beam-frame which is narrower than the distance between the wheels of the respective vehicle wheel pairs, so the beam-frame can be inserted beneath the damaged vehicle and secured firmly thereto with the aid of a number of attachment devices, such as chassis clamps.

There are many instances, however, when it is desirable to be able to roll the vehicle on its wheels onto the straightening bench. It has previously been proposed to replace the conventional frame in such straightening benches with a platform having a width enabling the vehicle to rest with its wheels located on the platform. The platform can either be made pivotable, so as to enable the vehicle to be driven thereon or may be provided with inclined drive-on ramps at one end for the same purpose.

The drawback with such chassis straightening benches is that the broad platform requires a large amount of space and does not permit the same ease of access to the vehicle chassis as an alignment bench with a narrow frame.

SUMMARY OF THE INVENTION

A vehicle chassis straightening bench having a horizontal beam-frame narrower than a vehicle with detachably mounted drive-on ramps to enable a vehicle to be rolled onto the bench and supported on the ramps by its wheels. The ramps have a plurality of preferably modular sections at least some of which can be removed after the vehicle is received on the bench.

Objects, features and advantages of this invention are to provide a chassis straightening bench of the beam-frame type which supports a vehicle on its wheels without obstructing access to the vehicle for securing the chassis to the bench and straightening the chassis, requires a minimal amount of floor space, is easy to manually set up and use, rugged, durable, and of relatively simple and economical design, manufacture and assembly.

BRIEF DESCRIPTION OF THE DRAWINGS

These and other objects, features and advantages of this invention will be apparent from the following detailed description, appended claims and accompanying drawings in which:

DETAILED DESCRIPTION

Figures 1, 2, 3:
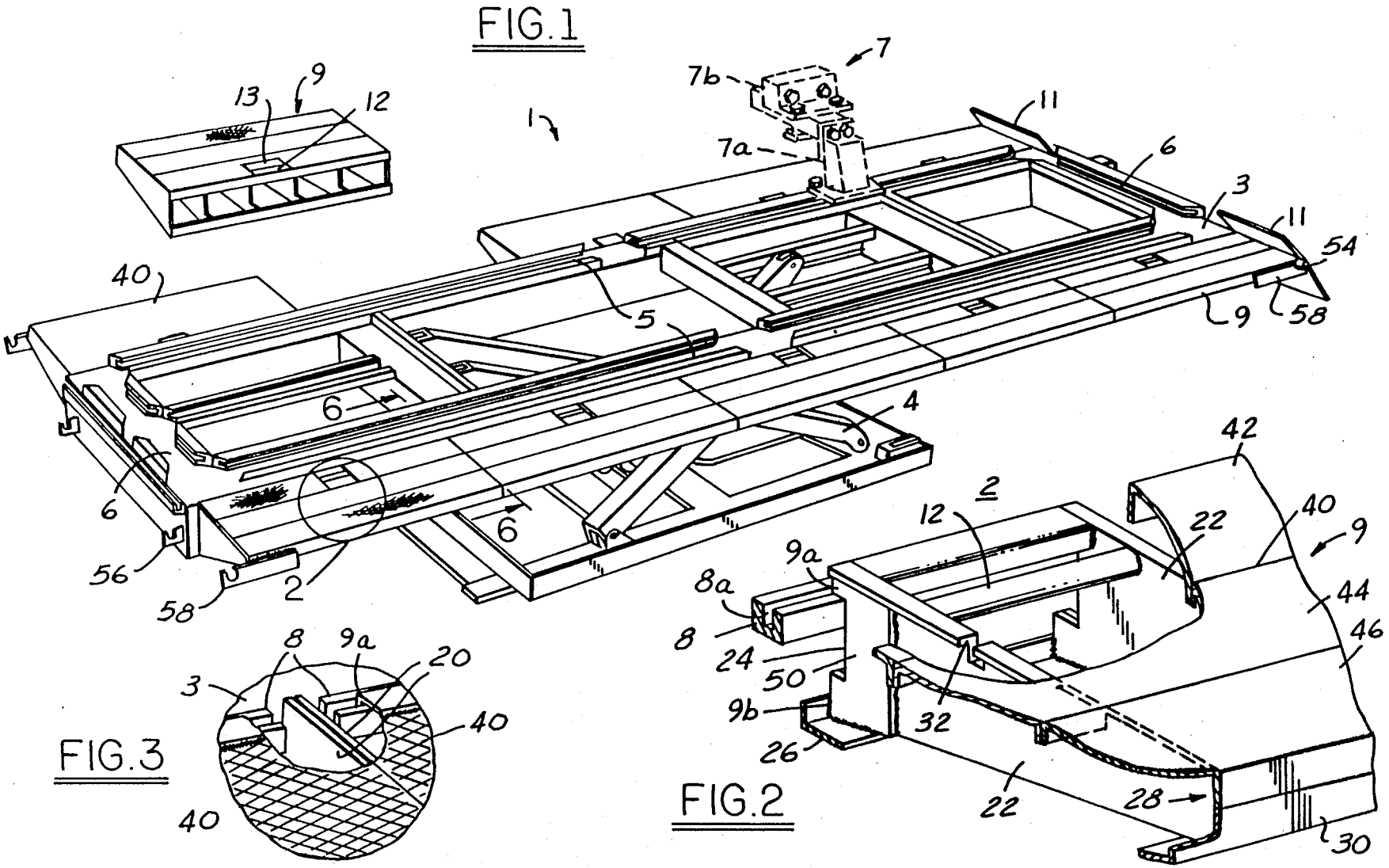
FIG. 1 is a perspective view of a chassis straightening or alignment bench with detachably mounting side ramps embodying this invention.
FIG. 2 is a fragmentary and enlarged perspective view of a side ramp section of FIG. 1 embodying this invention.
FIG. 3 is a fragmentary and enlarged perspective view of adjoining side ramp sections of FIG. 1 embodying this invention.
Figure 4:
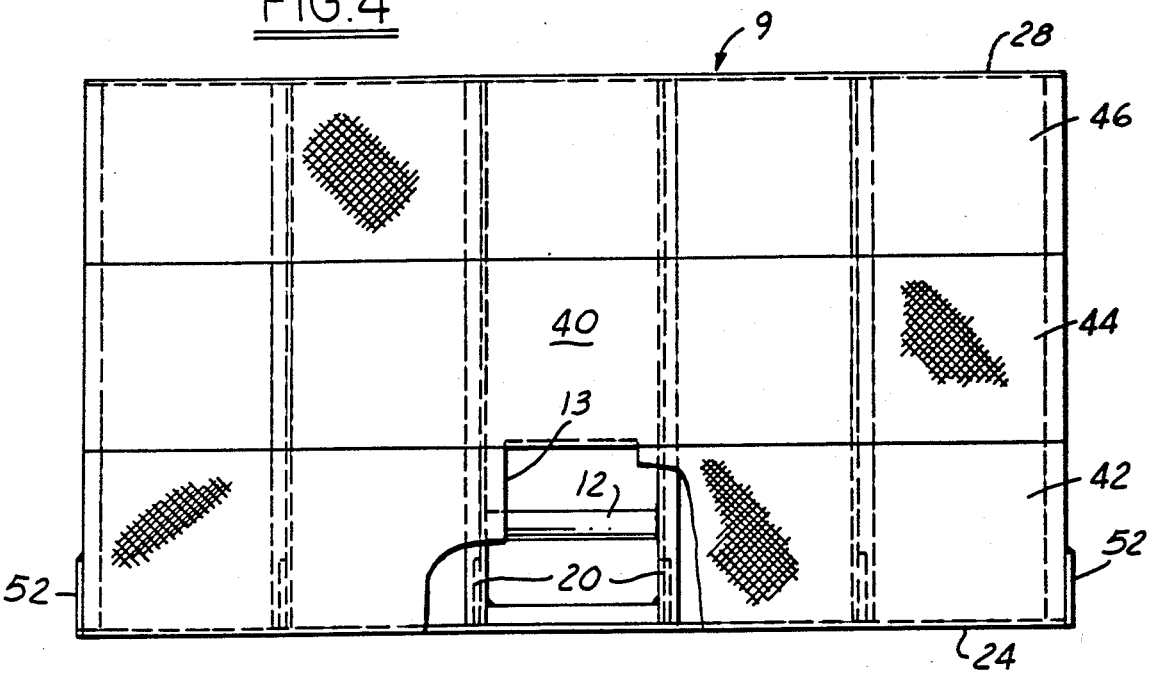
FIG. 4 is a top view of the side ramp section with portions broken away for purposes of illustration.

Referring in more detail to the drawings, FIG. 1 illustrates a vehicle chassis straightening bench 1 which includes a rectangular, horizontal steel beam-frame 3 which has a width narrower than the distance between the wheels of respective wheel pairs of a damaged vehicle to be clamped to the bench. The bench has a conventional scissor-like lifting device 4 which raises and lowers the frame 3 relative to a base plane 2, such as the floor of a workshop. The lifting device may be hydraulically operated.

The frame 3 has provided on the upper surface thereof longitudinally and transversely extending guide grooves or tracks 5 and 6 respectively, in which a selected number of securing devices, in the form of chassis clamps 7, can be fitted to hold the vehicle chassis firmly in relation to the frame 3. The chassis clamps 7 are intended to be secured in a known manner in one of the guide grooves 5 and 6 through the intermediary of one guide track slide **7*a* and to be clamped to the selected part of the chassis through the intermediary of another part normally in the form of jaw clamps 7*b***.

FIG. 2 illustrates holding devices with track sections 8 for detachably mounting side ramp sections 9. Preferably each track section 8 is an elongate steel member of square cross section attached, such as by welding, to the vertical external long side walls **3*a* of the frame 3. Each track has on its upper surface a channel 8*a* which extends parallel with the long side walls 3*a* and in which corresponding flanges or fingers 9*a* of side ramp sections 9 can be hooked and seated into the channel 8*a*. As shown in FIG. 3, preferably each track 8 has a plurality of spaced apart sections each with a length which acommodates only one side ramp section 9**. However, a single track could extend the entire length of each side of the bench.

Figure 6:
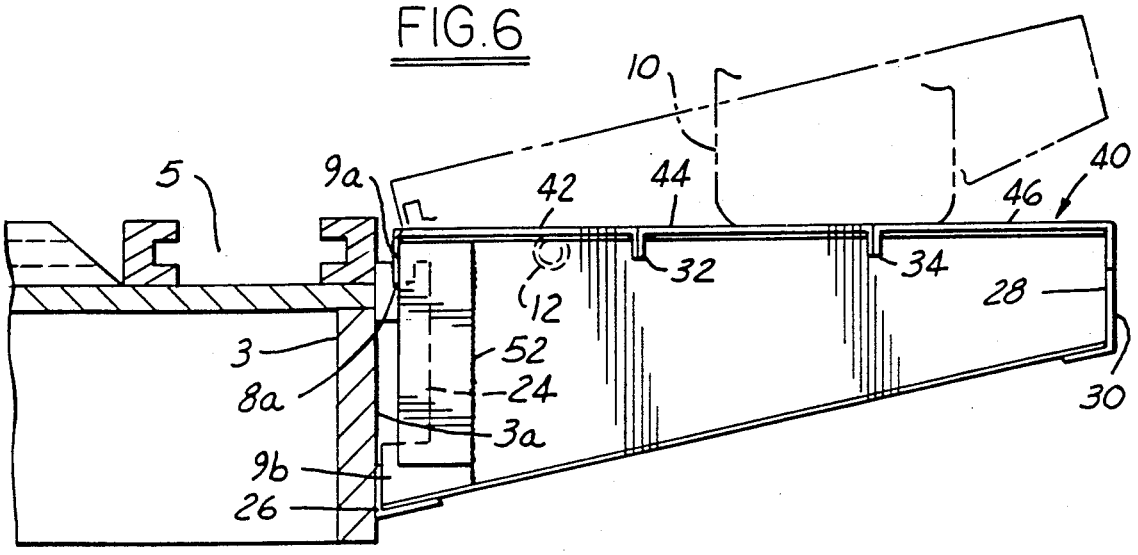
FIG. 6 is a fragmentary end view of the vehicle chassis straightening bench of FIG. 1 with a ramp section mounted thereon with its position just before mounting shown in phantom.

As shown in FIG. 6, the side ramp sections 9 provide a platform 40 for the vehicle wheels 10. Each ramp section 9 is preferably modular and is constructed of a material, such as low-carbon steel, which is capable of supporting heavy loads, i.e. damaged vehicles. Each side ramp section 9 has a handle 12, located adjacent to the fingers **9*a* and centered under the surface of the ramp section 9, which is fixedly attached to support cross members. An access opening 13 allows a hand to reach down to grasp the handle 12 to carry or lift the side ramp section 9**.

Each side ramp section 9 is designed to be a strong but lightweight structure. Each section 9 has a pair of exterior cross support plates 20 and a plurality of interior cross support plates 22 which run transverse of the beam-frame holding track 8. As shown in FIG. 6, a working edge 24 of each support plate 20,22 has a reverse C-shape slot with a top finger **9*a* for hooking into the holding track 8. On the lower portion of the working edge 24 is an outwardly projecting portion 9b secured to an angle iron reinforcement 26 which in assembly bears firmly against the long external wall 3a. From this working edge 24, all support plates 20,22 taper to a narrow outer edge 28 which is covered by and welded to a side plate 30**.

Each ramp section has a platform 40 provided by three channel shaped members 42,44 and 46 of expanded metal. The channel members bear on the top of each support plate 20,22 and have side edges received in equally spaced notches 32 and 34 which divide the support plate 20,22 into three equal sections. The channel 42 has a central access opening 13 for grasping the handle 12. The channel 42 fits over the working edge 24 and slips into the rear notch 32 of each support plate 20,22. The channels are welded together and to the support plates 20 and 22.

Figure 5:
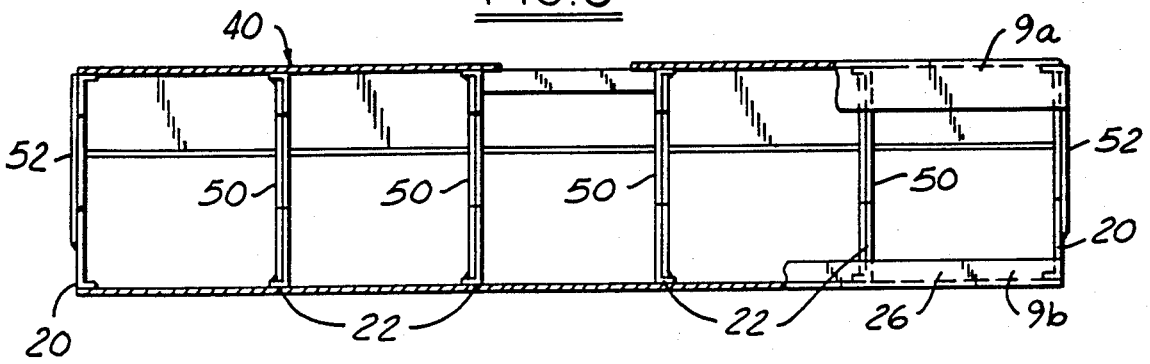
FIG. 5 is a side view of the ramp section of FIG. 3 with portions broken away for purposes of illustration.

As shown in FIG. 5, each interior support plate 22 has a reinforcement plate 50 welded to it. As shown in FIG. 2, each plate 50 has the same shape as the working edge 24 so that it also has a top finger 9a and a lower outwardly projecting portion 9b. As shown in FIG. 6, a generally rectangular shaped reinforcement and retainer plate 52 is welded to the outside of each exterior support plate 20. The addition of the plates 50 and 52 provides additional strength, stability and rigidity to the side ramp section 9.

As illustrated in FIG. 6, when it is required that a vehicle be rolled or driven onto the straightening bench, the side ramp sections 9 are lifted by their handles 12 and hooked onto the tracks 8. Preferably, as shown in phantom, each section is inclined to facilitate inserting its fingers 9a into the track 8. The section is then pivoted to the solid line position to seat the fingers 9a into channel 8a and the angle iron reinforcement 26 carried by the lower outwardly projecting edges 9b firmly against the side 3a of the bench.

Once the desired number of ramp sections 9 are in place, a vehicle can be rolled or driven onto the bench via roll-on ramps 11. The roll-on ramps 11 are pivotably carried by the short side or end of frame 3 and an adjacent ramp section 9 and are inclined relative to the base plane 2. Each roll-on ramp 11 has a solid bar 54 welded to side and center supports on the underside of the roll-on ramp. A pair of brackets 56 and 58 having slots to receive bar 54 are attached respectively to the beam-frame and the narrow outer edge 28 of an adjacent ramp section 9. Bracket 56 protrudes from the short side of the beam-frame only a small distance from the beam-frame corner. Bracket 58 is attached to the side ramp sections narrow edge 28 in a position properly aligned with bracket 56.

When the damaged vehicle is received on the ramps 9, the chassis is then raised by means of a jack or some other lifting device until the vehicle chassis reaches a position in which it can be fastened to the bench by chassis clamps 7. Such a lifting device is shown in U.S. patent application Ser. No. 212,874, (filed June 29, 1988) entitled a Lifting Arrangement in Vehicle Chassis Straightening Benches, assigned to the assignee of this application and filed concurrently herewith. After clamping the chassis to the frame 3 those side ramp sections 9 which no longer support a vehicle wheel 10 in the raised position of the chassis can be removed and, if required, replaced with special duty devices, such as wheel aligning plates for setting out and aligning the vehicle wheels.

I claim:

1. A vehicle chassis straightening bench comprising:

a horizontal beam-frame having a pair of laterally spaced apart and longitudinally extending sides which can be brought to a given position over a base plane and is narrower in width than the distance between the wheels of respective vehicle wheel pairs, a plurality of detachably mounting side ramp sections along each of said longitudinally extending sides of said frame, and mounting means carried by said frame and constructed and arranged to detachably mount each of said side ramp sections thereon, whereby the wheels of a vehicle can roll over and be supported by at least some of said ramp sections to place the vehicle chassis in a desired position above the beam-frame with its wheels on some of said side ramp sections.

2. The straightening bench of claim 1 wherein said mounting means comprises holding-devices which are fixedly attached to the two longitudinal sides of said frame whereby said side ramp sections can be detachably mounted onto such sides of said frame.

3. The straightening bench of claim 2 wherein said side ramp sections can be attached or detached from said frame before, during or after straightening operations.

4. The straightening bench of claim 1 which also comprises a plurality of attachment devices for firmly holding the vehicle while carrying out straightening operations, said attachment devices can be secured in selected positions along and/or transversely of the longitudinal direction of the frame in channels provided in the upper side of said frame.

5. The straightening bench of claim 1 which also comprises drive-on ramps which are inclined relative to the base plane, enable the vehicle to be rolled from the base plane onto said side ramp sections, and are located on at least one end of said frame.

6. The straightening bench of claim 1 wherein said side ramp section comprises:

a plurality of cross support plates equally spaced apart, a plurality of structural reinforcement plates fixedly attached to each said cross support plate, and a platform positioned transversly across, supported by, and fixedly attached to the top edge of said cross support plates, whereby wheels of a vehicle can roll over and be supported by said platform.

7. The side ramp section of claim 6 wherein each said cross support plate has a working edge having a finger to hook to said holding devices, an outwardly protruding edge to bear on a longitudinal side of said beam-frame, and a top edge with a plurality of notches to receive and to support said platform.

8. The side ramp section of claim 6 wherein said platform comprises a plurality of expanded metal channels providing a non-skid surface mounted on the top edge of said cross support plates.

9. A side ramp section of claim 6 wherein said structural reinforcement plates are welded onto the working edge of said cross support plates to provide strength and rigidity to the said side ram section.

10. The straightening bench of claim 1 wherein said side ramp section comprises a plurality of cross support plates having a plurality of notches along the top edge, a plurality of structural reinforcement plates welded to the side of said cross support plates and having a working edge that includes a finger to hook into said holding devices, a plurality of expanded metal channels placed transversly across the top edge of said cross support plates and fitted over the edges and into the notches along the top of said support plates to form a platform to support vehicle wheels, an angle iron reinforcement welded along the bottom of the working edge of said cross support plates, and a side plate welded to the narrow edge opposite the working edge of said cross support plates.

* * * * *